US007805095B2

(12) United States Patent
Zona et al.

(10) Patent No.: US 7,805,095 B2
(45) Date of Patent: Sep. 28, 2010

(54) CHARGING DEVICE AND AN IMAGE FORMING DEVICE INCLUDING THE SAME

(75) Inventors: Michael F. Zona, Holley, NY (US); Joseph A. Swift, Ontario, NY (US); Dan A. Hays, Fairport, NY (US); Fa-Gung Fan, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 455 days.

(21) Appl. No.: 11/363,004

(22) Filed: Feb. 27, 2006

(65) Prior Publication Data

US 2010/0119261 A1 May 13, 2010

(51) Int. Cl.
*G03G 15/02* (2006.01)

(52) U.S. Cl. ..... 399/168; 399/170; 399/171; 399/172; 399/173; 361/229; 361/230

(58) Field of Classification Search ..... 399/168, 399/170–173; 361/229–230
See application file for complete search history.

(56) References Cited

U.S. PATENT DOCUMENTS 5,077,468 A * 12/1991 Hamade ..... 250/324
5,354,607 A * 10/1994 Swift et al. ..... 310/251
6,493,529 B1 * 12/2002 Umemura et al. ..... 399/168
7,085,125 B2 * 8/2006 Sung ..... 361/502
7,149,460 B2 * 12/2006 Hays ..... 399/252
7,228,091 B2 * 6/2007 Hays et al. ..... 399/168
7,352,559 B2 * 4/2008 Sung ..... 361/502
7,397,032 B2 * 7/2008 Zona et al. ..... 250/326
7,715,743 B2 * 5/2010 Swift et al. ..... 399/50
2003/0122085 A1 * 7/2003 Stengl et al. ..... 250/423 F
2004/0175561 A1 * 9/2004 Duff, Jr. ..... 428/317.9
2006/0197018 A1 * 9/2006 Chen ..... 250/326
2008/0199195 A1 * 8/2008 Swift et al. ..... 399/50
2009/0002471 A1 * 1/2009 Leoni et al. ..... 347/127
2009/0303654 A1 * 12/2009 Fan et al. ..... 361/229

* cited by examiner

*Primary Examiner*—David M Gray
*Assistant Examiner*—Geoffrey T Evans
(74) *Attorney, Agent, or Firm*—Prass LLP

(57) ABSTRACT

A charging device comprises first and second electrodes forming a charging zone. A plurality of nanostructures adhere to at least one of the first and second electrodes. A charging voltage supply couples to the electrodes to support the formation of gaseous ions in the charging zone. An aperture electrode or grid proximate to the first and second electrodes is coupled to a grid control voltage supply which grid control voltage supply, in turn, controls a flow of gaseous ions from the charging zone to thereby charge a proximately-located receptor. In one embodiment, the charging voltage supply is arranged to provide a pulsed-voltage waveform. In one variation of this embodiment, the pulsed-voltage waveform comprises a pulsed-DC waveform. In another embodiment, the charging voltage supply is arranged to provide an alternating-current waveform. In one embodiment, the charging device itself is comprised in an image forming device.

8 Claims, 5 Drawing Sheets

CHARGING DEVICE AND AN IMAGE FORMING DEVICE INCLUDING THE SAME

INCORPORATION BY REFERENCE OF A PENDING U.S. PATENT APPLICATION

This application is related to the commonly-assigned pending application Ser. No. 11/149,392 filed on 10 Jun. 2005 by Dan A. Hays, Steven B. Bolte, Michael F. Zona and Joel A. Kubby, entitled "Compact charging method and device with gas ions produced by electric field electron emission and ionization from nanotubes," now pending, the disclosure of which pending application in its entirety hereby is totally incorporated herein by reference.

BACKGROUND OF THE INVENTION

Charging small diameter drums (<60 mm) has long been accomplished using contact charging methods, mostly bias charging rolls, due to their small size and ease of manufacture. The major disadvantage of charge roll technology is the need for high AC voltages (for uniform charging) that generate reactants which rapidly degrade the photoreceptor transport layer causing physical wearing of the surface. This wear limits the useable life of the photoreceptor device which drives system run costs up, especially in color systems that might have four photoreceptor devices. Non-contacting scorotrons operating at high DC voltage (5-9 kV) provide a alternative method to overcome wear issues, but have the downfall of generating ozone and NOx, and must be relatively large in size to overcome arcing issues between the coronode and surrounding device elements (that is, grids and shields).

Thus, there is a need for the present invention.

BRIEF SUMMARY OF THE INVENTION

In a first aspect of the invention, there is described a charging device comprising a first electrode and a second electrode that are arranged to form a charging zone therebetween; a plurality of nanoelements or nanostructures, such as nanorods, nanowires, and nanotubes are disposed on the first electrode; a charging voltage supply operatively coupled to the first and second electrodes; where the charging voltage supply is arranged to provide a pulsed-voltage waveform.

In a second aspect of the invention, there is described a charging device comprising a first electrode and a second electrode that are arranged to form a charging zone therebetween; a plurality of nanostructures disposed on the first and second electrodes; a charging voltage supply operatively coupled to the first and second electrodes; where the charging voltage supply is arranged to provide an alternating-current waveform.

In a third aspect of the invention, there is described an image forming device including a charging device, the charging device comprising a first electrode and a second electrode that are arranged to form a charging zone therebetween; a plurality of nanostructures disposed on the first electrode; a charging voltage supply operatively coupled to the first and second electrodes; where the charging voltage supply is arranged to provide a pulsed-voltage waveform.

In a fourth aspect of the invention, there is described an image forming device including a charging device, the charging device comprising a first electrode and a second electrode that are arranged to form a charging zone therebetween; a plurality of nanostructures disposed on the first and second electrodes; a charging voltage supply operatively coupled to the first and second electrodes; where the charging voltage supply is arranged to provide an alternating-current waveform.

As used herein, the term "alternating current" (commonly abbreviated as "AC"), when applied to pulsed-DC waveforms, is intended to include sinusoidal (commonly known as "sine") waveforms and pulsed waveforms of all types, including square waveforms.

Figure 3:
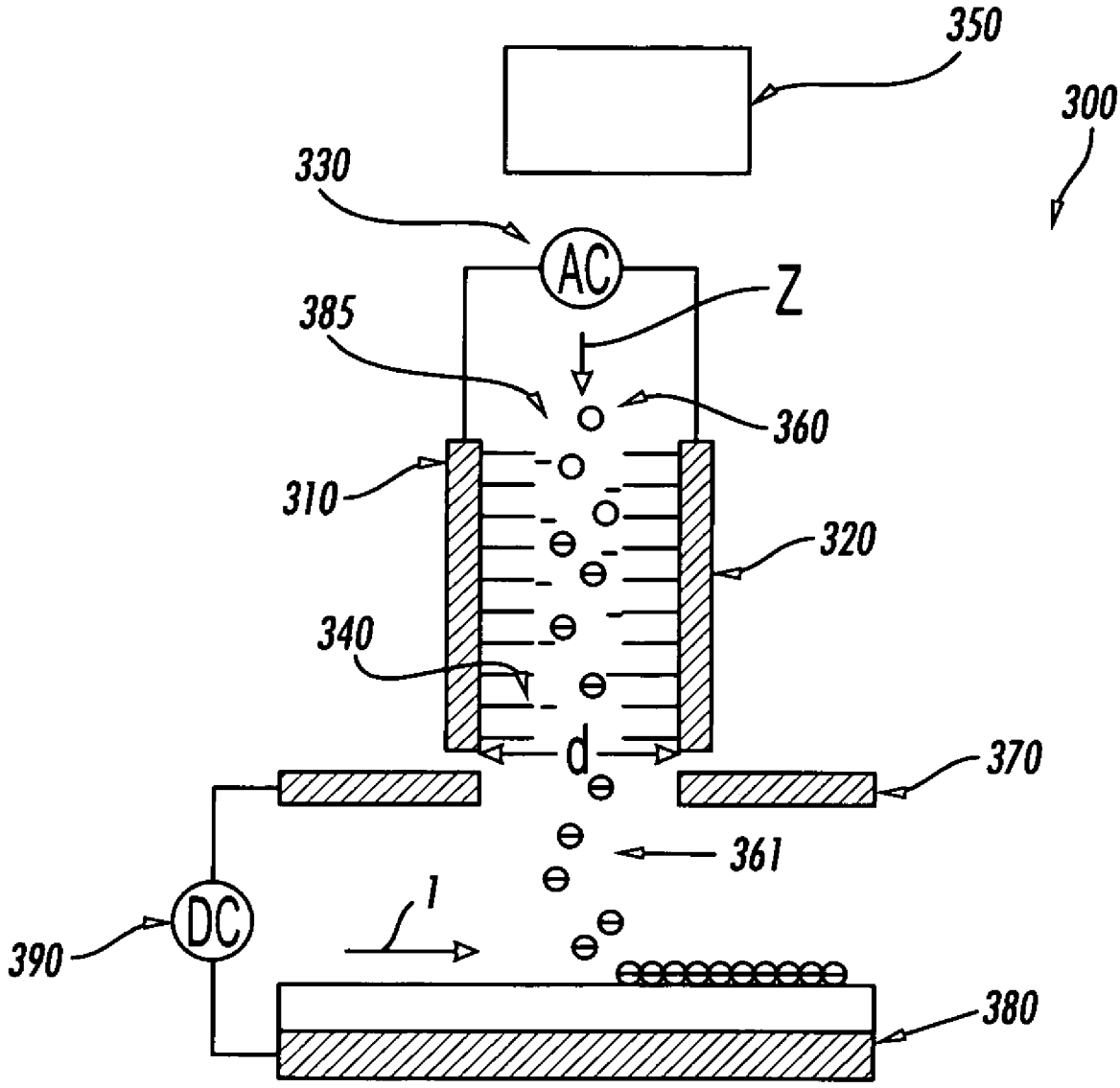
FIG. 3 depicts a second embodiment 300 of a charging device, in accordance with the present invention. As shown, the charging device 300 comprises a first electrode 310 and a second electrode 320 that are arranged to form a charging zone 385 therebetween. A plurality of nanostructures 340 are disposed on, electromechanically coupled to, physically contacting, coated upon or adhere to the first electrode 310 and the second electrode 320. A charging voltage supply 330 is operatively coupled to the first 310 and second 320 electrodes to support the formation of gaseous ions 361 in the charging zone 385. As depicted in FIG. 3, the charging voltage supply 330 is arranged to provide an alternating current ("AC") waveform.

As shown in FIG. 3, the charging device 300 further comprises a gas supply unit 350 arranged to supply gaseous material 360 to the charging zone 385. The charging device 300 also includes an aperture electrode or grid 370 proximate to the charging zone 385 and coupled to an included grid control voltage supply 390. In turn, the grid control voltage supply 390 is arranged to control a flow of gaseous ions 361 from the charging zone 385 to thereby charge a proximately-located receptor 380. Also depicted in FIG. 3 is the receptor 380 travel path, or the process or downstream direction 1.

Figure 2:
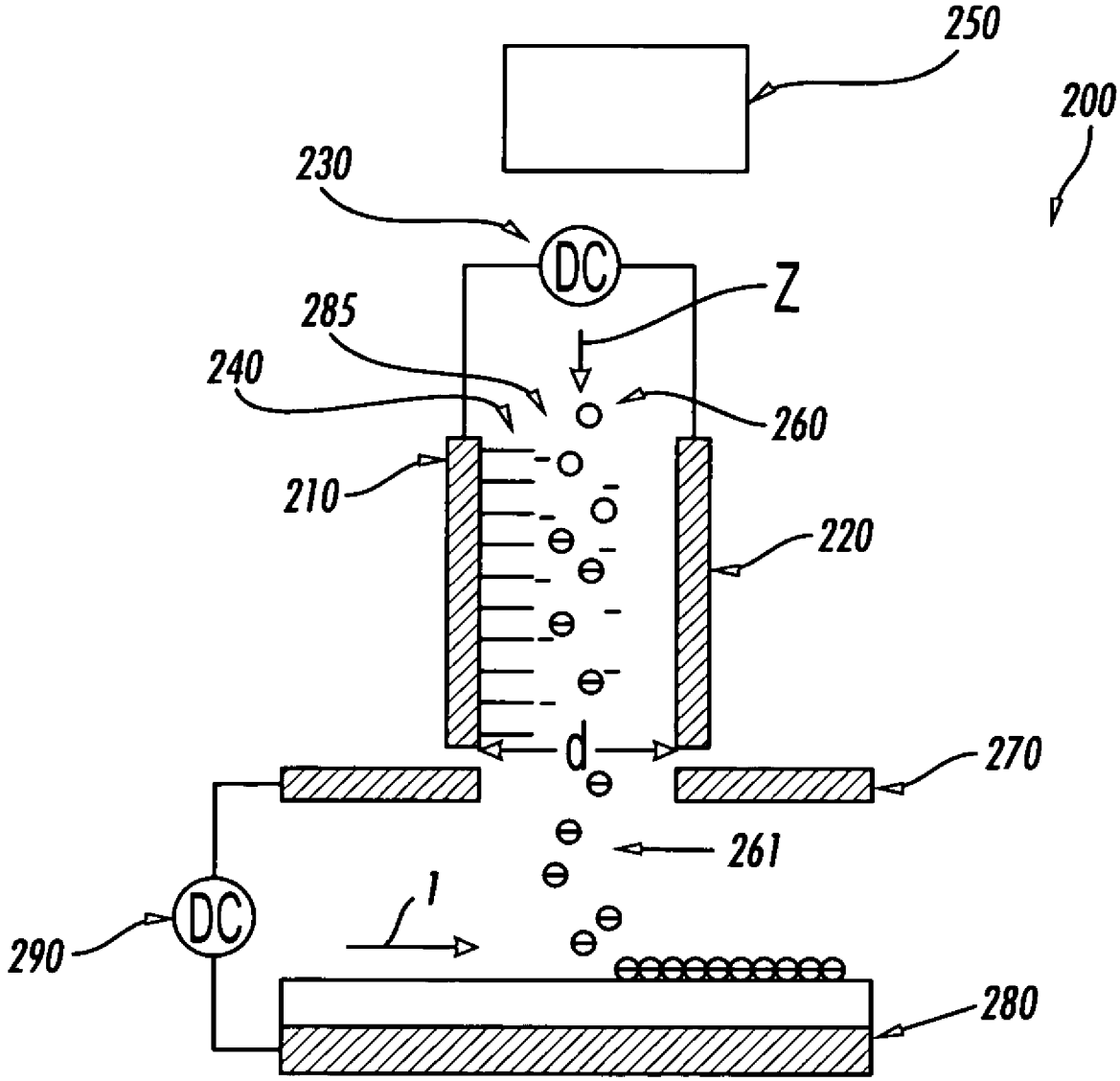
FIG. 2 depicts a first embodiment 200 of a charging device, in accordance with the present invention. As shown, the charging device 200 comprises a first electrode 210 and a second electrode 220 that are arranged to form a charging zone 285 therebetween. A plurality of nanostructures 240 are disposed on, electromechanically coupled to, physically contacting, coated upon or adhere to the first electrode 210. A charging voltage supply 230 is operatively coupled to the first 210 and second 220 electrodes to support the formation of gaseous ions 261 in the charging zone 285. As depicted in FIG. 2, the charging voltage supply 230 is arranged to provide a pulsed-voltage waveform. In one embodiment, the pulsed-voltage waveform 230 comprises a pulsed direct-coupled or direct current ("DC") voltage waveform. As shown, the charging device 200 further comprises a gas supply unit 250 arranged to supply gaseous material 260 to the charging zone 285. The charging device 200 also includes an aperture electrode or grid 270 proximate to the charging zone 285 and coupled to an included grid control voltage supply 290. In turn, the grid control voltage supply 290 is arranged to control a flow of gaseous ions 261 from the charging zone 285 to thereby charge a proximately-located receptor 280. Also depicted in FIG. 2 is the receptor 280 travel path 1. For good understanding, the receptor travel path 1 also is known as the "process" or "downstream" direction 1.
Figure 4:
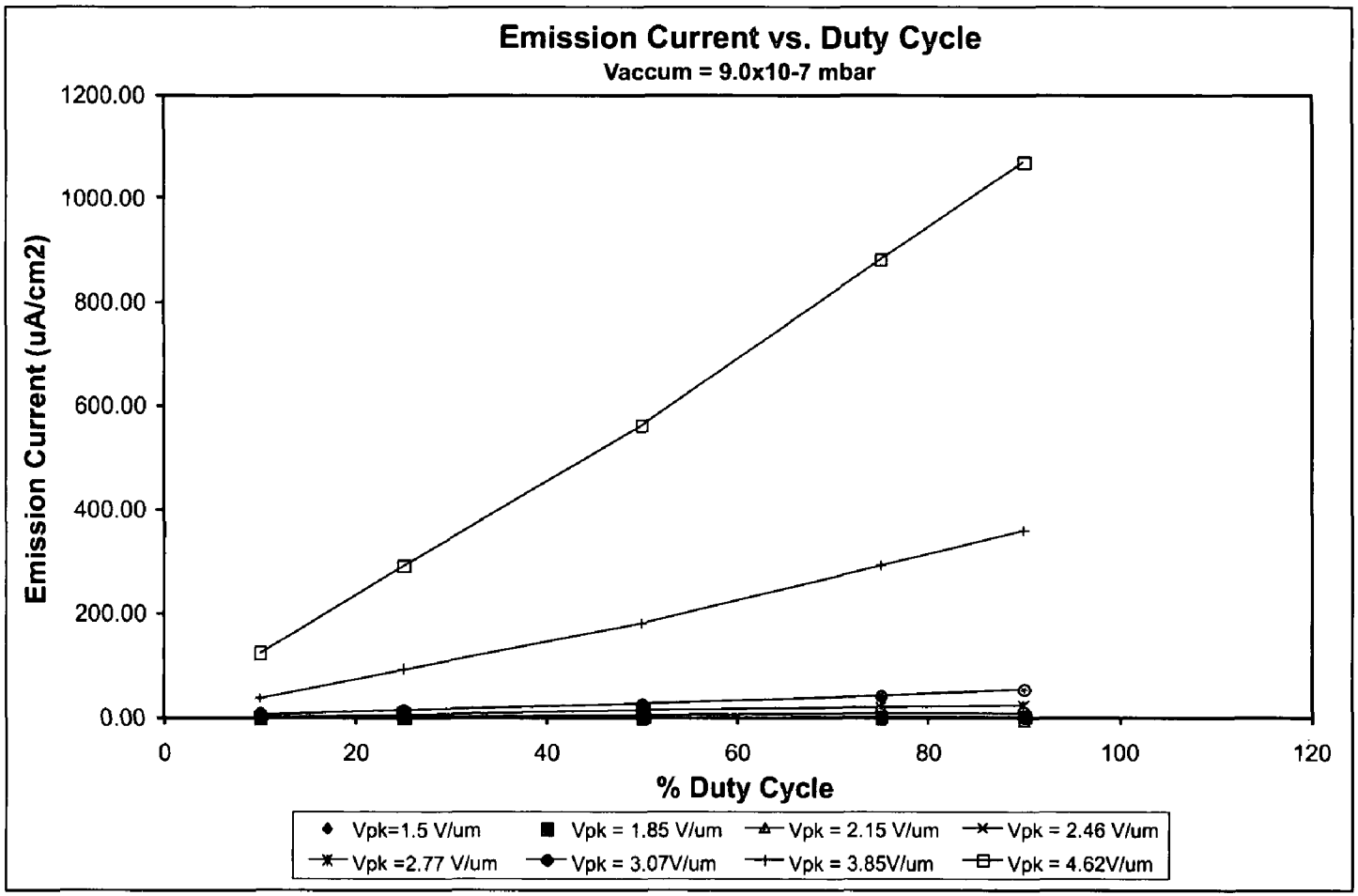

FIG. 4 depicts an average current density at the counter electrode 220 of the FIG. 2 charging device 200 as a function of the duty cycle when the charging voltage supply 230 applies a pulsed DC voltage waveform to the nanostructures 240.

Figure 5:
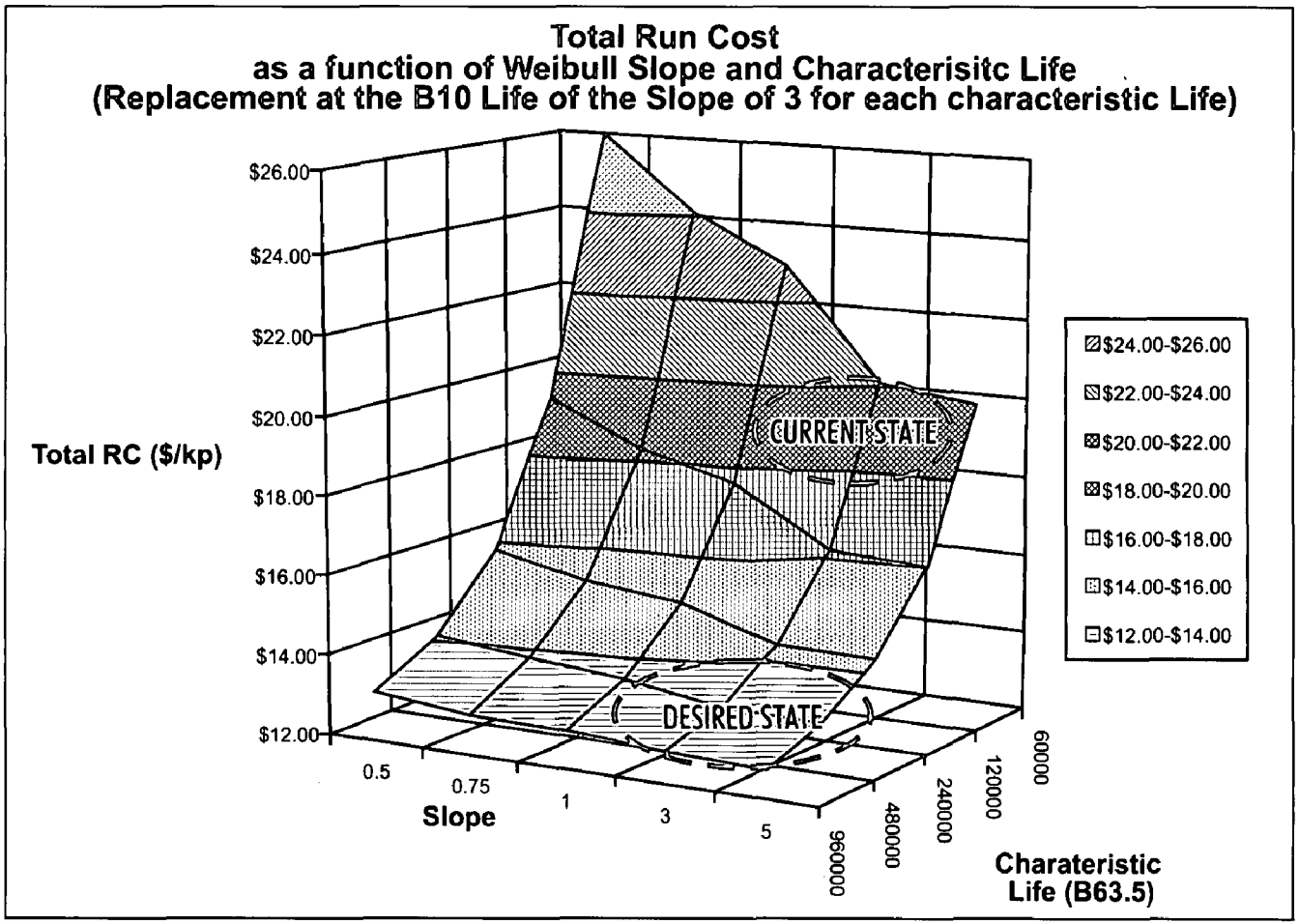

FIG. 5 depicts how a system run cost is impacted by increasing the life of Xerographic Replaceable Units (XRUs).

DETAILED DESCRIPTION OF THE INVENTION

The present disclosure offers a low voltage solution using a non-contacting charge device that enables reduction in size and low ozone/NOx generation.

Briefly, a charging device comprises first and second electrodes forming a charging zone. A plurality of nanostructures adhere to at least one electrode of the first electrode and the second electrode. A charging voltage supply couples to the electrodes to support the formation of gaseous ions in the charging zone. An aperture electrode or grid proximate to the first and second electrodes is coupled to a grid control voltage supply which grid control voltage supply, in turn, controls a flow of gaseous ions from the charging zone to thereby charge a proximately-located receptor.

In one embodiment, the charging voltage supply is arranged to provide a pulsed-voltage waveform. In one variation of this embodiment, the pulsed-voltage waveform comprises a pulsed-DC waveform.

In another embodiment, the charging voltage supply is arranged to provide an alternating-current waveform. In one variation of this embodiment, the charging voltage supply is arranged to provide a pulsed alternating-current waveform.

In one embodiment, the charging device itself is comprised in an image forming device.

Figure 1:
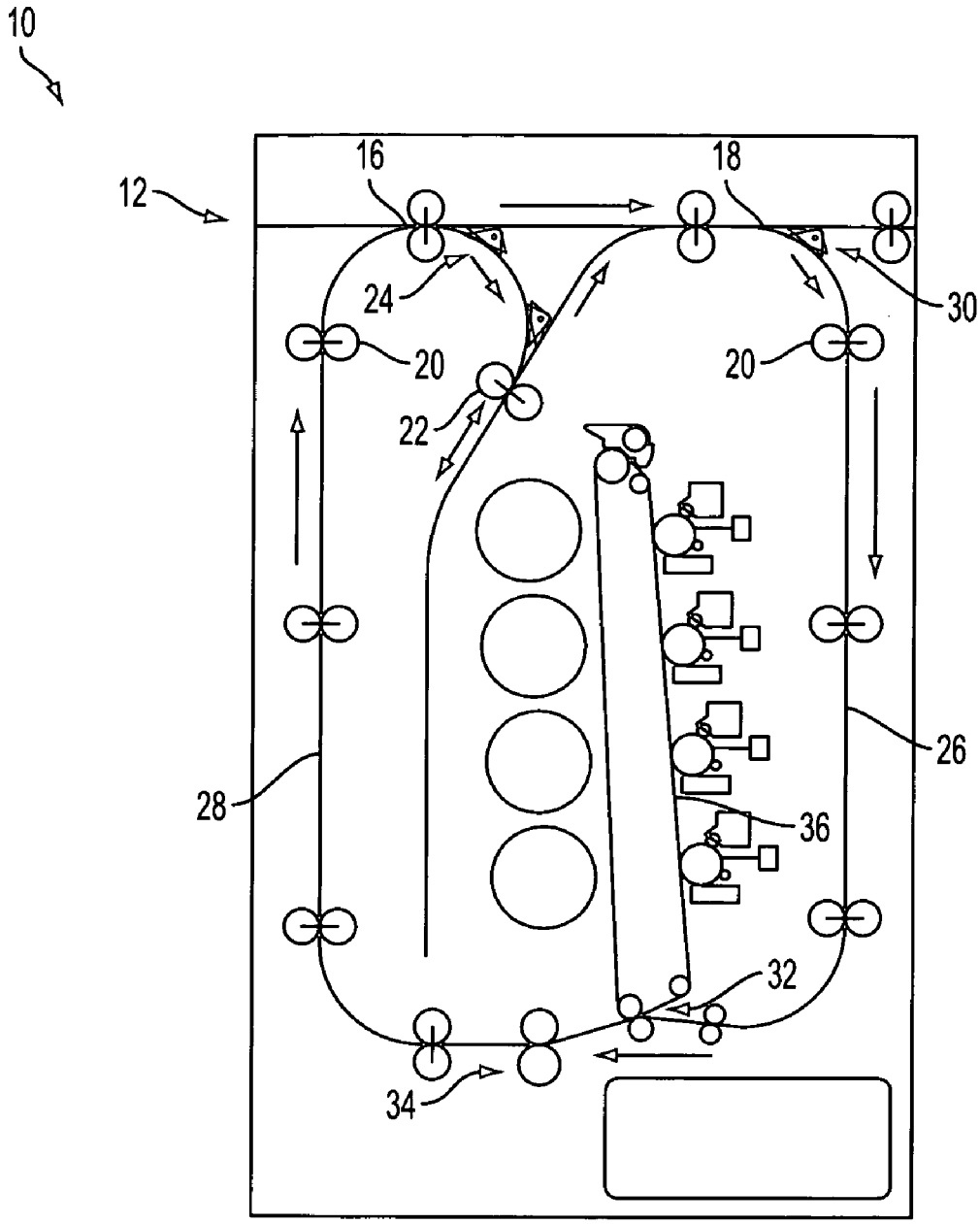
FIG. 1 depicts an image forming device 10. In one embodiment, the image forming device 10 comprises an integrated marking engine ("IME"). In one embodiment, the image forming device 10 comprises any of the charging device 200 as described in connection with FIG. 2 below and the charging device 300 as described in connection with FIG. 3 below. In one embodiment, the image forming device 10 comprises a xerographic printing device. In variations of this embodiment, the xerographic printing device comprises any of a printer, copier and facsimile device.

Referring now to FIG. 1 there is depicted an image forming device 10. In one embodiment, the image forming device 10 comprises an integrated marking engine ("IME"). In one embodiment, the image forming device 10 comprises any of the charging device 200 as described in connection with FIG. 2 below and the charging device 300 as described in connection with FIG. 3 below. In one embodiment, the image forming device 10 comprises a xerographic printing device. In variations of this embodiment, the xerographic printing device comprises any of a printer, copier and facsimile device. In one embodiment, the image forming device 10 comprises a xerographic printing device. In variations of this embodiment, the xerographic printing device comprises any of a printer, copier and facsimile device.

Still referring to FIG. 1, in one embodiment the image forming device 10 is similar or identical to the exemplary electrophotographic reproducing apparatus that is described in connection with FIG. 1 of the aforementioned pending U.S. patent application Ser. No. 11/149,392 filed 10 Jun. 2005 by Dan A. Hays, Steven B. Bolte, Michael F. Zona and Joel A. Kubby, entitled "Compact charging method and device with gas ions produced by electric field electron emission and ionization from nanostructures", hereinafter referred to as the "pending Dan A. Hays et al. application", the disclosure of which pending Dan A. Hays et al. application hereinabove is incorporated by reference, verbatim, and with the same effect as though the same disclosure were fully and completely set forth herein.

In one embodiment of the present disclosure, generally as described in connection with FIG. 2 below, a pulsed-DC waveform is used to generate charging fields in cold cathode charging devices using nanostructures for current emitters or corona generators.

In one embodiment of the present disclosure, generally as described in connection with FIG. 3 below, an alternating-current waveform is used to generate charging fields in cold cathode charging devices using nanostructures for current emitters or corona generators.

Previous disclosures have described a device to generate negative ions by applying a field between nanostructures and a counter electrode and forcing the generated ions to a photoreceptor surface for charging. By using pulsed DC instead of straight DC or AC sine waves, space charge effects are reduced for high injection current conditions. Also, in various embodiments the duty cycle of the pulsed DC is used by process controls to adjust the current density delivered by the emitters to control the final voltage of the photoreceptor.

Referring now to FIG. 2, there is shown a first embodiment of a charging device 200 in accordance with the present invention. For good understanding, this first charging device 200 is based on the charging device 300 that is described in the pending Dan A. Hays et al. application.

As shown in FIG. 2, the charging device 200 comprises a first electrode 210 and a second electrode 220 that are arranged to form a gap or charging zone 285 therebetween. A plurality of nanostructures 240 are disposed on, electromechanically coupled to, physically contacting, coated upon or adhere to the first electrode 210. A charging voltage supply 230 is operatively coupled to the first electrode 210 and the second electrode 220. In accordance with the present invention, the charging voltage supply 230 is arranged to provide a pulsed voltage waveform.

As shown, in one embodiment a gas supply unit 250 is arranged to supply a gaseous material 260 into the gap or charging zone 285.

As shown, in one embodiment the charging device 200 includes an aperture electrode or grid 270 proximate to the charging zone 285.

As depicted in FIG. 2, in one embodiment, the charging device 200 is arranged to supply charge to a proximately-located receptor 280. The receptor 280 travel path, or process or downstream direction, is depicted by reference number 1.

While FIG. 2 shows the plurality of nanostructures 240 adhering to the first electrode 210, in various embodiments the plurality of nanostructures are formed on any of the first electrode 210, the second electrode 220, or both electrodes 210 and 220.

Referring still to FIG. 2, in one embodiment the charging voltage supply 230 provides a negative (−) pulsed-DC waveform bias 230 to the nanostructure-coated electrode 210 to cause electron field emission. Maximum field emission current is obtained when the nanostructures 240 are oriented perpendicular to the conductive substrate 210 at an optimum surface coverage.

In FIG. 2 the flow of gaseous material 260 into the charging zone 285 is depicted by the reference letter "Z". Once in the charging zone 285, the gaseous material becomes ionized in the charging zone 285 between the electrodes 210 and 220. Thereafter the resulting gaseous ions 261 exit the electron-filled charging zone 285 proximate to a negative-DC-voltage-biased aperture electrode or grid 270.

The negative DC voltage bias on the aperture electrode or grid 270, in turn, is provided by an included grid control voltage supply 290. The aperture electrode or grid 270 negative DC bias establishes an electric field between the ion charging device 200 and the proximately-located receptor 280 such as, for example, a photoreceptor to be charged.

When the surface potential of the receptor 280 becomes comparable to the voltage output of the grid control voltage supply 290, the charging will cease. Thus, the receptor 280 will acquire a uniform surface potential even though the ion current is not necessarily uniform in the cross-process direction.

Still referring to FIG. 2, in various embodiments any multiplicity or plurality of individual electrodes 210 and 220 are configured to form the charging zone 285.

Also, in various embodiments any multiplicity or plurality of closely-spaced individual charging zones 285 are arranged in the process direction 1 to allow high process speed charging of the receptor 280.

In various embodiments, the substrates of the first 210 and second 220 electrodes are fabricated from various conductive materials such as metals, metal-coated glass, indium tin oxide coated glass, metal-coated plastic, doped silicon and conductive organic composite materials. The dimensions of the electrodes are typically centimeters in the direction of the gas flow and tens of centimeters perpendicular in the cross-process direction.

In various embodiments, the first 210 and second 220 electrodes are closely spaced, separated by a gap or distance that is depicted in FIG. 2 by reference letter "d".

In various embodiments, for example, the distance "d" is from about 10 microns to about 1000 microns, or from about 100 microns to about 600 microns.

As shown, the electrodes 210 and 220 are substantially parallel to, and opposing, one another to form the charging zone 285 therebetween.

In various embodiments, the nanostructures 240 are comprised of various materials such as, for example, carbon, boron nitride, zinc oxide, bismuth, and metal chalcogenides.

Also in various embodiments, the nanostructures are overcoated or surface modified to achieve operational stability in various gas environments.

As used herein, the term "nanostructures" and "nanoelements" are used interchangeable herein and will be understood to mean single-walled nanostructures (SWNT), multi-walled nanostructures (MWNT), horns, spirals, rods, wires, and/or fibers. The nanoelements can have any regular or irregular cross-sectional shape including, for example, circular round, oval, elliptical, rectangular, square, and the like. Typically, in various embodiments individual nanoelements have a diameter of from 1 to 500 nanometers, or from about 10 to 200 nanometers and a length of up to hundreds of microns. By controlling various parameters, such as composition, shape, length, etc., the electrical, mechanical, and thermal properties of the nanostructures can be controlled. For example, the nanostructures can be formed to be conducting, semi-conducting, or insulating, depending on, for example, the chirality of the nanostructures. Moreover, the nanostructures can have yield stresses greater than that of steel. Additionally, the nanostructures can have thermal conductivities greater than that of copper, and in some cases, comparable to, or greater than that of diamond.

In various embodiments, the nanostructures are fabricated by a number of methods including arc discharge, pulsed laser vaporization, chemical vapor deposition (CVD), electrodeposition or electroplating, electroless deposition, and high pressure carbon monoxide processing. However, it will be understood by those of ordinary skill in the art that other fabrication methods can also be used.

In various embodiments, the nanostructures 240 are formed to have their principle axis perpendicular to the substrate on which they are adhered, such as the first electrode 210 and/or the second electrode 220. In the case of fabrication using CVD with a catalyst, the nanostructures can be SWNT and can orient perpendicular to the substrate as shown, for example, in FIGS. 2-3.

In various embodiments, nanostructures 240 are irregularly-spaced and in certain embodiments, regularly-spaced on at least a portion of one of the first electrode 210, the second electrode 220, or both electrodes 210 and 220.

As used herein, the term "regularly spaced" is understood to mean that the nanostructures 240 are spaced apart from each other at a distance that is typically equal and the distance may be greater than an average height of the nanostructures.

In various embodiments, the nanostructures 240 form a regular lattice such as a hexagonal array.

In various embodiments, the charging voltage supply 230 applies a negative DC bias to the first electrode 210 comprising the nanostructures 240. The negative DC bias causes an electron field emission from the nanostructures 240. In turn, the electron field emission supplies electrons to the charging zone 285. Further, in various embodiments, maximum ionization in the charging zone 285 is obtained when the nanostructures 240 are regularly-spaced and oriented generally perpendicularly to the conductive substrate 210.

As shown in FIG. 2, gaseous material 260 enters charging device 200 from the gas supply unit 250. The negative bias applied to the first electrode 210 supplies electrons to the charging zone 285. Further, the electrons cause a portion of the gaseous material 260 to become negatively-charged, thus forming gaseous ions 261.

As shown in FIG. 2, the ionized gaseous material 260 flowing through charging zone 285 passes through or proximate to the aperture electrode or grid 270.

As discussed above, in various embodiments a grid control voltage supply 290 is provided and electrically connected between the aperture electrode or grid 270 and the receptor 280. In various embodiments, the grid control voltage supply 290 applies a negative DC bias to the aperture electrode or grid 270.

In one embodiment, the negative-biased aperture electrode or grid 270 establishes an electric filed between the charging device 200 and the proximately-located receptor 280.

In various embodiments, the grid control voltage supply 290 provides a voltage of from about negative 400 Volts to about negative 1400 Volts between the aperture electrode or grid 270 and the receptor 280. When the surface potential of the receptor 280 becomes comparable to the negative DC bias applied by the grid control voltage supply 290, the charging on the receptor 280 ceases and the surface potential of the receptor is approximately equal to the voltage output of the grid control voltage supply 290.

In various embodiments, the receptor 280 acquires a uniform surface potential even though the ion current may not necessarily be uniform in the cross-process direction.

In various embodiments, the gaseous material 260 flowing through the charging device 200 contains electronegative molecular species to facilitate electron attachment on the gas molecules. For example, when air is used as the gaseous material 260, the dominant negative ion species at atmospheric pressure is $CO_3$—. The precursor of $CO_3$— is $CO_2$ that reacts with O— or $O_3$— to form the $CO_3$— ion.

In various embodiments, the gaseous material 260 comprises electronegative gaseous materials such as $CO_2$ and $O_2$.

In various embodiments, the gas supply unit 250 is provided by either compressors, blowers or pressurized gas cylinders.

For example, in one embodiment the gas supply unit 250 supplies the gaseous material 260 at very high speeds through the charging zone 285 generally in a direction Z. In some embodiments, the gas supply unit 250 flows the gaseous material 260 in an air or gas stream near the speed of sound, or about 240 m/s Alternatively, the range of gas speeds is from about 50 m/s to about 200 m/s. In various embodiments, the drift speed of the ionized gaseous material 261 from the first electrode to the second electrode is between 50 m/s and 250 m/s, and in some cases, near 100 m/s.

In various embodiments, flowing the gaseous material 260 at relatively high speeds prevents ion deposition on electrodes which are devoid of nanostructures such as, for example, the second electrode 220 as depicted in FIG. 2.

In various embodiments, instead of a DC voltage between the first electrode 210 and the second electrode 220, a pulsed voltage source is used with a wave shape that provides a time average field value near zero Volts.

Moreover, in certain embodiments to achieve electron field emission, the macroscopic electric field in the gap between the first electrode 210 and the second electrode 220 is in the range of about 0.5 V/micron to about 4 V/micron. The mobility of the ions in the gaseous material 260 is typically about 1 cm/Vs.

Referring still to FIG. 2, in one embodiment the pulsed-voltage waveform 230 comprises a wave shape that provides a time-average value at or near zero Volts.

In one embodiment, the pulsed-voltage waveform 230 comprises a pulsed-DC waveform having a magnitude of from about negative 100 Volts to about negative 1500 Volts.

In one embodiment, the pulsed-DC waveform 230 comprises a periodic waveform.

In one embodiment, the pulsed-DC waveform 230 comprises a frequency of about 50 to 500 Hertz ("Hz").

As used herein, the term "Hertz" (commonly abbreviated as "Hz"), when applied to pulsed-DC waveforms, is intended to mean pulses per second.

In one embodiment, the pulsed-DC waveform 230 comprises a frequency of from about 0.1 Hz to about 1 Mega-Hz.

In one embodiment, the pulsed-DC waveform 230 comprises a duty cycle of from about 5 per-cent (5%) to about 99 per-cent (99%).

In one embodiment, the pulsed-voltage waveform 230 comprises a pulsed-DC waveform having a magnitude of from about negative 100 Volts to about negative 1500 Volts, a frequency of from about 0.1 Hz to about 1 Mega-Hz and a duty cycle of from about 5 per-cent (5%) to about 99 per-cent (99%), whereas the wave shape of the pulsed-voltage waveform preferably provides a time-average voltage at or near zero volts.

In one embodiment, the pulsed-voltage waveform 230 comprises a plurality or series of successive pulses, where the pulses comprise a positive polarity.

In one embodiment, the pulsed-voltage waveform 230 comprises a plurality or series of successive pulses, where the pulses comprise a negative polarity.

In one embodiment, the pulsed-voltage waveform 230 comprises a plurality or series of successive pulses, where some of the pulses comprise a positive polarity and some of the pulses comprise a negative polarity.

In one embodiment, the pulsed-voltage waveform 230 comprises a plurality or series of successive pulses, where the pulses comprise a polarity that alternates between positive and negative so that each pulse comprises a polarity that is opposite to the polarity of the pulse that immediately precedes the each pulse.

In one embodiment, the pulsed-voltage waveform 230 comprises a plurality or series of successive pulses, where the pulses comprise a polarity that is based on a predetermined pattern.

Charging Device 200 Examples

The following charging device 200 examples 201-209 are illustrative:

Example 201: The pulsed-voltage waveform 230 comprises a pulsed-DC waveform having a magnitude of from about negative 100 Volts to about negative 1500 Volts, a frequency of 0.1 Hz and a duty cycle of 5 per-cent (5%).

Example 202: The pulsed-voltage waveform 230 comprises a pulsed-DC waveform having a magnitude of from about negative 100 Volts to about negative 1500 Volts, a frequency of 0.1 Hz and a duty cycle of 50 per-cent.

Example 203: The pulsed-voltage waveform 230 comprises a pulsed-DC waveform having a magnitude of from about negative 100 Volts to about negative 1500 Volts, a frequency of 0.1 Hz and a duty cycle of 99 per-cent (99%).

Example 204: The pulsed-voltage waveform 230 comprises a pulsed-DC waveform having a magnitude of from about negative 100 Volts to about negative 1500 Volts, a frequency of 100 Hz and a duty cycle of 5 per-cent (5%).

Example 205: The pulsed-voltage waveform 230 comprises a pulsed-DC waveform having a magnitude of from about negative 100 Volts to about negative 1500 Volts, a frequency of 100 Hz and a duty cycle of 50 per-cent.

Example 206: The pulsed-voltage waveform 230 comprises a pulsed-DC waveform having a magnitude of from about negative 100 Volts to about negative 1500 Volts, a frequency of 100 Hz and a duty cycle of 99 per-cent (99%).

Example 207: The pulsed-voltage waveform 230 comprises a pulsed-DC waveform having a magnitude of from about negative 100 Volts to about negative 1500 Volts, a frequency of 1 Mega-Hz and a duty cycle of 5 per-cent (5%).

Example 208: The pulsed-voltage waveform 230 comprises a pulsed-DC waveform having a magnitude of from about negative 100 Volts to about negative 1500 Volts, a frequency of 1 Mega-Hz and a duty cycle of 50 per-cent.

Example 209: The pulsed-voltage waveform 230 comprises a pulsed-DC waveform having a magnitude of from about negative 100 Volts to about negative 1500 Volts, a frequency of 1 Mega-Hz and a duty cycle of 99 per-cent (99%).

Referring still to FIG. 2, using a pulsed-DC waveform in the charging voltage supply 230 as described in connection with FIG. 2 above provides at least three (3) advantages compared to using the prior straight DC waveform as in the pending Dan A. Hays et al. application. This is explained below.

A first advantage of using a pulsed-DC waveform in the charging voltage supply 230 as described in connection with FIG. 2 above is based on the resistive heating of the nanostructure tips that can occur in the straight DC waveform of the pending Dan A. Hays et al. application. This heating can potentially degrade the emission performance due to modification of the tip geometry, unwanted chemical changes to the tip material, or changes to the effective work function of the tip, thereby limiting the device efficiency and life. In contrast, by using the present pulsed-DC waveform in the voltage supply 230, the maximum temperature rise due to resistive heating is greatly reduced.

A second advantage of using a pulsed-DC waveform in the charging voltage supply 230 as described in connection with FIG. 2 above is that it reduces the adverse space charge effects associated with the prior straight DC waveform of the pending Dan A. Hays et al. application under conditions when the injected current density is high. This is explained below.

Under DC conditions, the space charge electric field due to a high injected current density will reduce the applied electric field at the charge injecting electrode 210. This reduction in net electric field reduces the charge injection. There are two major forces acting on the generated ions.

The first is the force from the electric field between the nanostructures 240 and the counter electrode 220.

The second is the force from the airflow being directed from the top of the device toward the receptor.

With the prior straight DC waveform of the pending Dan A. Hays et al. application, the ions generated are drawn to the counter electrode 220. This mobility created by the electric field prevents ions generated at the inlet of the charging device 200 from ever reaching the receptor 280. In contrast, as the present pulsed DC mode provides no field or a low reverse field between pulses, the resulting airflow has greater ability to move in the direction Z as shown in FIG. 2 and thereby deposit the generated ions on the receptor 280. This leads to a larger amount of charge going to the intended receptor 280 instead being collected by the counter electrode 220.

A third advantage of using a pulsed-DC waveform in the charging voltage supply 230 as described in connection with FIG. 2 above is the ability to tune the average current density of the emitters.

Further to the foregoing third advantage, the present drawing view labeled FIG. 4 shows the average current density at the counter electrode as a function of the duty cycle when a pulsed DC voltage is applied to the nanostructures. By adjusting the duty cycle through machine process control, the final voltage of the receptor can be controlled to a desired level. The duty cycle can be increased or reduced depending on feedback from sensors, that is, receptor voltage, patch density, etc.

Moreover, the aforementioned three (3) advantages of using a pulsed-DC waveform in the charging voltage supply 230 as described in connection with FIG. 2 above enables the cold charger concept shown above to function as a more viable option for low waterfront charging for small diameter drum photoreceptors.

In Tightly Integrated Parallel Process (TIPP) or Rack Mounted Printing (RMP) printing architectures, the goal is to combine multiple low-speed products into one machine that operates at much higher speed. Run cost and intervention rate are extremely important to customers in the markets for these higher speed machines.

For example, the present drawing view labeled FIG. 5 shows how the system run cost is impacted by increasing the life of the Xerographic Replaceable Units (XRUs) for these architectures. By implementing a non-contact, small footprint charger into these configurations, we can enable XRUs that last 200 k prints (B10) or more, which has a significant impact on the system run cost. For example, without longer XRU lives, replacement intervals could be daily or greater requiring multiple replacements per day. Since the market requires intervention rates that are low, for example, 1 or 2 per week, implementing the proposed device and extending the XRU life to 200 k prints (B10) enables improved intervention rates.

Referring now to FIG. 3, there is shown a second embodiment of a charging device 300 in accordance with the present invention. For good understanding, this second charging device 300 is based on the charging device 400 that is described in the pending Dan A. Hays et al. application.

As shown in FIG. 3, the charging device 300 comprises a first electrode 310 and a second electrode 320 that are arranged to form a gap or charging zone 385 therebetween. A plurality of nanostructures 340 are disposed on, electromechanically coupled to, physically contacting, coated upon or adhere to the first electrode 310 and the second electrode 320. As shown, a charging voltage supply 330 is operatively coupled to the first electrode 310 and the second electrode 320. As shown in FIG. 3, the charging voltage supply 330 is arranged to provide an alternating-current waveform.

In one embodiment, a gas supply unit 350 is arranged to supply a gaseous material 360 into the gap or charging zone 385 between the first electrode 310 and the second electrode 320.

In one embodiment, the charging device 300 includes an aperture electrode or grid 370 proximate to the charging zone 385.

As depicted in FIG. 3, in one embodiment, the charging device 300 is arranged to supply charge to a proximately-located receptor 380.

Still referring to FIG. 3, in various embodiments any multiplicity or plurality of individual electrodes 310 and 320 are configured to form the charging zone 385.

Also, in various embodiments any multiplicity or plurality of closely-spaced individual charging zones 385 are arranged in the process direction 1 to allow high process speed charging of the receptor 380.

In various embodiments, the substrates of the first 310 and second 320 electrodes are fabricated from various conductive materials such as metals, metal-coated glass, indium tin oxide coated glass, metal-coated plastic, doped silicon and conductive organic composite materials. The dimensions of the electrodes are typically centimeters in the direction of the gas flow and tens of centimeters perpendicular in the cross-process direction.

In various embodiments, the first electrode 310, the second electrode 320, including their arrangement, the nanostructures 340 including their arrangement, the gas supply unit 350, the aperture electrode or grid 370, and the receptor 380 are similar to the corresponding elements that are described in connection with FIG. 2 above.

Still referring to FIG. 3, in one embodiment the charging voltage supply 330 is arranged to provide a sinusoidal-shaped AC voltage waveform between the first electrode 310 and the second electrode 320.

As shown, in one embodiment the charging voltage supply 330 is arranged to provide a pulsed-shaped AC voltage waveform between the first electrode 310 and the second electrode 320.

As shown, in one embodiment the charging voltage supply 330 is arranged to provide a square wave-shaped AC voltage waveform between the first electrode 310 and the second electrode 320.

Referring still to FIG. 3, in one embodiment a series of voltage pulses are used instead of the steady DC voltage during each half cycle. During the half AC cycle, when one of the coated electrodes, thus, either the first electrode 310 or the second electrode 320, as the case may be, is at a negative (−) potential and the opposing coated electrode, thus, either the second electrode 320 or the first electrode 310, as the case may be, is at a positive (+) potential, electrons are field emitted into the charging zone 385 from the negatively biased electrode. During the next half cycle, the role of the coated electrodes is reversed. In this way, the gaseous material 360 flowing through the charging zone 385 is alternately subjected to electrons from each of the nanostructure-covered electrodes 310 and 320.

In various embodiments, when an electrode is at a positive (+) potential, it is possible for gas molecules in the gaseous material 360 near the nanostructures 340 to be field ionized. However, the threshold field for field ionization is typically larger than the threshold field for the electron emission.

In various embodiments, when the AC frequency of the charging voltage supply 330 is sufficiently high to prevent ion deposition on the electrodes 310 and 320, the ions undergo an oscillatory path while moving through the charging zone 385. In an exemplary embodiment, when the peak-to-peak amplitude of the ion oscillatory path is less than 1 mm, a frequency of greater than about 100 kHz is used for a drift speed of 100 m/s. In this example, the gas speed through the charging device 300 is as low as 10 m/s, which is much less than the speed of sound.

As shown in FIG. 3, in one embodiment, the alternating-current waveform 330 comprises a plurality or series of successive pulses, where some of the pulses comprise a positive polarity and some of the pulses comprise a negative polarity.

In one embodiment, the alternating-current waveform 330 comprises a plurality or series of successive pulses, where the pulses comprise a polarity that alternates between positive and negative so that each pulse comprises a polarity that is opposite to the polarity of the pulse that immediately precedes the each pulse.

In one embodiment, the alternating-current waveform 330 comprises a plurality or series of successive pulses, where the pulses comprise a polarity that is based on a predetermined pattern.

Still referring to FIG. 3, in one embodiment an AC waveform 330 is applied to the nanostructure-coated electrodes 310 and 320 to cause electron field emission. Maximum field emission current is obtained when the nanostructures 340 are oriented perpendicular to the conductive substrates 310 and 320 at an optimum surface coverage.

As shown in FIG. 3, gaseous ions 361 flowing through the gap 385 between the electrodes 310 and 320 exit the electron-filled charging zone 385 proximate to a negative-DC-voltage-biased aperture electrode or grid 370.

The negative DC voltage bias on the aperture electrode or grid 370, in turn, is provided by an included grid control voltage supply 390. The aperture electrode or grid 370 negative DC bias establishes an electric field between the ion charging device 300 and the proximately-located receptor 380, such as a photoreceptor, to be charged. When the surface potential of the receptor 380 becomes comparable to the voltage output of the grid control voltage supply 390, the charging will cease. Thus, the receptor 380 will acquire a uniform surface potential even though the ion current is not necessarily uniform in the cross-process direction.

Still referring to FIG. 3, in one embodiment, the alternating-current waveform 330 comprises a wave shape that provides a time average voltage at or near zero.

In one embodiment, the alternating-current waveform 330 comprises a square wave-shaped AC voltage waveform with a peak magnitude of from about 50 Volts to about 750 Volts, or a peak-to-peak magnitude of from about 100 Volts to about 1500 Volts.

In one embodiment, the alternating-current waveform 330 comprises a frequency of about 100 Hz.

In one embodiment, the alternating-current waveform 330 comprises a frequency of from about 0.1 Hz to about 1 Mega-Hz.

Charging Device 300 Examples

The following charging device 300 examples 301-309 are illustrative:

Example 301: The pulsed-voltage waveform 330 comprises a square wave having a peak magnitude of 50 Volts, or a peak-to-peak magnitude of 100 Volts, and a frequency of 0.1 Hz.

Example 302: The pulsed-voltage waveform 330 comprises a square wave having a peak magnitude of 50 Volts, or a peak-to-peak magnitude of 100 Volts, and a frequency of 100 Hz.

Example 303: The pulsed-voltage waveform 330 comprises a square wave having a peak magnitude of 50 Volts, or a peak-to-peak magnitude of 100 Volts, and a frequency of 1 Mega-Hz.

Example 304: The pulsed-voltage waveform 330 comprises a square wave having a peak magnitude of 500 Volts, or a peak-to-peak magnitude of 1000 Volts, and a frequency of 0.1 Hz.

Example 305: The pulsed-voltage waveform 330 comprises a square wave having a peak magnitude of 500 Volts, or a peak-to-peak magnitude of 1000 Volts, and a frequency of 100 Hz.

Example 306: The pulsed-voltage waveform 330 comprises a square wave having a peak magnitude of 500 Volts, or a peak-to-peak magnitude of 1000 Volts, and a frequency of 1 Mega-Hz.

Example 307: The pulsed-voltage waveform 330 comprises a square wave having a peak magnitude of 750 Volts, or a peak-to-peak magnitude of 1500 Volts, and a frequency of 0.1 Hz.

Example 308: The pulsed-voltage waveform 330 comprises a square wave having a peak magnitude of 750 Volts, or a peak-to-peak magnitude of 1500 Volts, and a frequency of 100 Hz.

Example 309: The pulsed-voltage waveform 330 comprises a square wave having a peak magnitude of 750 Volts, or a peak-to-peak magnitude of 1500 Volts, and a frequency of 1 Mega-Hz.

In summary, a charging device 200 as described in connection with FIG. 2 above comprises first 210 and second 220 electrodes forming a charging zone 285 therebetween. A plurality of nanostructures 240 are disposed on, electromechanically coupled to, physically contacting, coated upon or adhere to at least one of the first electrode 210 and the second electrode 220. A charging voltage supply 230 couples to the electrodes to support the formation of gaseous ions 261 in the charging zone 285. An aperture electrode or grid 270 proximate to the electrodes 210 and 220 is coupled to a grid control voltage supply 290 which grid control voltage supply 290, in turn, is arranged to control a flow of gaseous ions 261 from the charging zone 285 to thereby charge a proximately-located receptor 280.

In accordance with the present invention, the charging voltage supply 230 is arranged to provide a pulsed-voltage waveform. In one variation, the pulsed-voltage waveform comprises a pulsed-DC waveform with a time average voltage at or near zero.

In one embodiment, the charging device 200 itself is comprised in an image forming device 10.

In further summary, a charging device 300 as described in connection with FIG. 3 above comprises first 310 and second 320 electrodes forming a charging zone 385 therebetween. A plurality of nanostructures 340 are disposed on, electromechanically coupled to, physically contacting, coated upon or adhere to at least one of the first 310 and second 320 electrodes. A charging voltage supply 330 couples to the electrodes to support the formation of gaseous ions 361 in the charging zone 385. An aperture electrode or grid 370 proximate to the electrodes 310 and 320 is coupled to a grid control voltage supply 390 which grid control voltage supply 390, in turn, is arranged to control a flow of gaseous ions 361 from the charging zone 385 to thereby charge a proximately-located receptor 380.

In accordance with the present invention, the charging voltage supply 330 is arranged to provide an alternating-current waveform with pulsed voltages.

In one embodiment, the charging device 300 itself is comprised in an image forming device 10.

Thus, there is described the first aspect of the invention, namely, a charging device 200 as described in connection with FIG. 2 above, the charging device 200 comprising a first electrode 210 and a second electrode 220 that are arranged to form a charging zone 285 therebetween; a plurality of nanostructures 240 being disposed on, electromechanically coupled to, physically contacting, coated upon or adhere to the first electrode 210; a charging voltage supply 230 operatively coupled to the first 210 and second 220 electrodes; where the charging voltage supply 230 is arranged to provide a pulsed-voltage waveform.

The following eighteen (18) sentences labeled A through R apply to the foregoing first aspect of the invention:

A. In one embodiment, the pulsed-voltage waveform 230 comprises a wave shape that provides a time-average value that is at or near zero.

B. In one embodiment, the pulsed-voltage waveform 230 comprises a plurality or series of successive pulses, where the pulses comprise a positive polarity.

C. In one embodiment, the pulsed-voltage waveform 230 comprises a plurality or series of successive pulses, where the pulses comprise a negative polarity.

D. In one embodiment, the pulsed-voltage waveform 230 comprises a plurality or series of successive pulses, where some of the pulses comprise a positive polarity and some of the pulses comprise a negative polarity.

E. In one embodiment, the pulsed-voltage waveform 230 comprises a plurality or series of successive pulses, where the pulses comprise a polarity that alternates between positive and negative so that each pulse comprises a polarity that is opposite to the polarity of the pulse that immediately precedes the each pulse.

F. In one embodiment, the pulsed-voltage waveform 230 comprises a plurality or series of successive pulses, where the pulses comprise a polarity that is based on a predetermined pattern.

G. In one embodiment, the pulsed-voltage waveform 230 comprises a pulsed-DC waveform having a magnitude of from about negative 100 Volts to about negative 1500 Volts.

H. In one embodiment, the pulsed-DC waveform 230 comprises a periodic waveform.

I. In one embodiment, the pulsed-DC waveform 230 comprises a frequency of about 50 to 500 Hz.

J. In one embodiment, the pulsed-DC waveform 230 comprises a frequency of from about 0.1 Hz to about 1 Mega-Hz.

K. In one embodiment, the pulsed-DC waveform 230 comprises a duty cycle of from about 5 per-cent (5%) to about 99 per-cent (99%).

L. In one embodiment, the charging device 200 further comprises a gas supply unit 250 arranged to supply gaseous material to the charging zone 285, an aperture electrode or grid 270 proximate to the charging zone 285 and coupled to an included grid control voltage supply 290, the grid control voltage supply 290 arranged to control a flow of gaseous ions 261 from the charging zone 285 to thereby charge a proximately-located receptor 280.

M. In one embodiment, the nanostructures 240 comprise at least one of carbon, boron nitride, zinc oxide, bismuth, metal chalcogenides, metals, metal-coated glass, indium tin oxide coated glass, metal-coated plastic, doped silicon and conductive organic composite materials, and where the nanostructures further comprise at least one of single-walled nanostructures (SWNT), multi-walled nanostructures (MWNT), horns, spirals, rods, wires, and fibers.

N. In one embodiment, the first electrode 210 and the second electrode 220 are separated by a gap or distance (d) of from about 10 microns to about 500 microns.

O. In one embodiment, the nanostructures 240 are modified to achieve operational stability in a gas environment.

P. In one embodiment, the nanostructures 240 are regularly spaced on the first electrode 210 such that the spacing is greater than an average height of the nanostructures.

Q. In one embodiment, the charging voltage supply 230 is operatively coupled to the first 210 and second 220 electrodes to support the formation of gaseous ions 261 in the charging zone 285.

R. In one embodiment, the pulsed-voltage waveform 230 comprises a pulsed-DC waveform having a magnitude of from about negative 100 Volts to about negative 1500 Volts, a frequency of from about 0.1 Hz to about 1 Mega-Hz and a duty cycle of from about 5 per-cent (5%) to about 99 per-cent (99%), whereas the wave shape of the pulsed-voltage waveform preferably provides a time-average voltage at or near zero volts.

Also, there is described the second aspect of the invention, namely, a charging device 300 as described in connection with FIG. 3 above, the charging device 300 comprising a first electrode 310 and a second electrode 320 that are arranged to form a charging zone 385 therebetween; a plurality of nanostructures 340 being disposed on, electromechanically coupled to, physically contacting, coated upon or adhere to the first 310 and second 320 electrodes; a charging voltage supply 330 operatively coupled to the first 310 and second 320 electrodes; where the charging voltage supply 330 is arranged to provide an alternating-current waveform.

The following fourteen (14) sentences labeled S through F1 apply to the foregoing second aspect of the invention:

S. In one embodiment, the alternating-current waveform 330 comprises a plurality or series of successive pulses, where some of the pulses comprise a positive polarity and some of the pulses comprise a negative polarity.

T. In one embodiment, the alternating-current waveform 330 comprises a plurality or series of successive pulses, where the pulses comprise a polarity that alternates between positive and negative so that each pulse comprises a polarity that is opposite to the polarity of the pulse that immediately precedes the each pulse.

U. In one embodiment, the alternating-current waveform 330 comprises a plurality or series of successive pulses, where the pulses comprise a polarity that is based on a predetermined pattern.

V. In one embodiment, the alternating-current waveform 330 comprises a wave shape that provides a time average voltage at or near zero.

W. In one embodiment, the alternating-current waveform 330 comprises a square wave with a peak magnitude of from about 50 Volts to about 750 Volts, or a peak-to-peak magnitude of from about 100 Volts to about 1500 Volts.

X. In one embodiment, the alternating-current waveform 330 comprises a frequency of about 50 to 500 Hz.

Y. In one embodiment, the alternating-current waveform 330 comprises a frequency of from about 0.1 Hz to about 1 Mega-Hz.

Z. In one embodiment, the charging device 300 further comprises a gas supply unit 350 arranged to supply gaseous material to the charging zone 385, an aperture electrode or grid 370 proximate to the charging zone 385 and coupled to an included grid control voltage supply 390, the grid control voltage supply 390 arranged to control a flow of gaseous ions 361 from the charging zone 385 to thereby charge a proximately-located receptor 380.

A1. In one embodiment, the nanostructures 340 comprise at least one of carbon, boron nitride, zinc oxide, bismuth, metal chalcogenides, metals, metal-coated glass, indium tin oxide coated glass, metal-coated plastic, doped silicon and conductive organic composite materials, and where the nanostructures further comprise at least one of single-walled nanostructures (SWNT), multi-walled nanostructures (MWNT), horns, spirals, rods, wires, and fibers.

B1. In one embodiment, the first electrode 310 and the second electrode 320 are separated by a gap or distance (d) of from about 10 microns to about 500 microns.

C1. In one embodiment, the nanostructures 340 are modified to achieve operational stability in a gas environment.

D1. In one embodiment, the nanostructures 340 are regularly spaced on the first electrode 310 and the second electrode 320 such that the spacing is greater than an average height of the nanostructures.

E1. In one embodiment, the charging voltage supply 330 is operatively coupled to the first 310 and second 320 electrodes to support the formation of gaseous ions 361 in the charging zone 385.

F1. In one embodiment, the charging voltage supply 330 is arranged to provide a pulsed alternating-current waveform.

Also, there is described the third aspect of the invention, namely, an image forming device 10 including a charging device 200, where the charging device 200 is described in connection with FIG. 2 above. As described in connection with FIG. 2 above, the charging device 200 comprises a first electrode 210 and a second electrode 220 that are arranged to form a charging zone 285 therebetween; a plurality of nanostructures 240 being disposed on, electromechanically coupled to, physically contacting, coated upon or adhere to the first electrode 210; a charging voltage supply 230 operatively coupled to the first 210 and second 220 electrodes; where the charging voltage supply 230 is arranged to provide a pulsed-voltage waveform.

The following nine (9) sentences labeled G1 through O1 apply to the foregoing third aspect of the invention:

G1. In one embodiment, the pulsed-voltage waveform 230 comprises a wave shape that provides a time average voltage that is at or near zero.

H1. In one embodiment, the pulsed-voltage waveform 230 comprises a pulsed-DC waveform having a magnitude of from about negative 100 Volts to about negative 1500 Volts.

I1. In one embodiment, the pulsed-DC waveform 230 comprises a periodic waveform.

J1. In one embodiment, the pulsed-DC waveform 230 comprises a frequency of about 50 to 500 Hz.

K1. In one embodiment, the pulsed-DC waveform 230 comprises a duty cycle of from about 5 per-cent (5%) to about 99 per-cent (99%).

L1. In one embodiment, the charging voltage supply 230 is operatively coupled to the first 210 and second 220 electrodes to support the formation of gaseous ions 261 in the charging zone 285.

M1. In one embodiment, the pulsed-voltage waveform 230 comprises a pulsed-DC waveform having a magnitude of from about negative 100 Volts to about negative 1500 Volts, a frequency of from about 0.1 Hz to about 1 Mega-Hz and a duty cycle of from about 5 per-cent (5%) to about 99 per-cent (99%).

N1. In one embodiment, the image forming device 10 comprises a xerographic printing device. In variations of this embodiment, the xerographic printing device comprises any of a printer, copier and facsimile device.

O1. In one embodiment, the image forming device 10 is based on the electrophotographic reproducing apparatus described in connection with FIG. 1 of the pending Dan A. Hays et al. application.

Also, there is described the fourth aspect of the invention, namely, an image forming device 10 including a charging device 300, where the charging device 300 is described in connection with FIG. 3 above. As described in connection with FIG. 3 above, the charging device 300 comprises a first electrode 310 and a second electrode 320 that are arranged to form a charging zone 385 therebetween; a plurality of nanostructures 340 being disposed on, electromechanically coupled to, physically contacting, coated upon or adhere to the first 310 and second 320 electrodes; a charging voltage supply 330 operatively coupled to the first 310 and second 320 electrodes; where the charging voltage supply 330 is arranged to provide an alternating-current waveform.

The following seven (7) sentences labeled P1 through V1 apply to the foregoing fourth aspect of the invention:

P1. In one embodiment, the alternating-current waveform 330 comprises a wave shape that provides a time average voltage at or near zero.

Q1. In one embodiment, the alternating-current waveform 330 comprises a sine wave with a peak magnitude of from about 50 Volts to about 750 Volts, or a peak-to-peak magnitude of from about 100 Volts to about 1500 Volts.

R1. In one embodiment, the alternating-current waveform 330 comprises a frequency of about 50 to 500 Hz.

S1. In one embodiment, the charging voltage supply 330 is operatively coupled to the first 310 and second 320 electrodes to support the formation of gaseous ions 361 in the charging zone 385.

T1. In one embodiment, the image forming device 10 comprises a xerographic printing device. In variations of this embodiment, the xerographic printing device comprises any of a printer, copier and facsimile device.

U1. In one embodiment, the charging voltage supply 330 is arranged to provide a pulsed alternating-current waveform.

V1. In one embodiment, the image forming device 10 is based on the electrophotographic reproducing apparatus described in connection with FIG. 1 of the pending Dan A. Hays et al. application.

The table below lists the drawing element reference numbers together with their corresponding written description:

REF. NO.: DESCRIPTION d spacing or gap between the electrodes
Z flow direction of gaseous material
1 receptor travel path, process or downstream direction
10 image forming device, or integrated marking engine ("IME")
12 media input area
16 feed roll nip
18 media exit area
20 feed roll nip
22 inverter paper path

24 duplex diverter
26 pre-marker paper path
28 post parker paper path
30 marker path diverter
32 toner transfer area
34 inverter paper path
36 intermediate transfer belt
100 image forming device
200 charging device
210 first electrode
220 second electrode
230 charging voltage supply
240 nanostructures
250 gas supply unit
260 gaseous material
261 gaseous ions
270 aperture electrode or grid
280 receptor
285 gap or charging zone
290 grid control voltage supply
300 charging device
310 first electrode
320 second electrode
330 charging voltage supply
340 nanostructures
350 gas supply unit
360 gaseous material
361 gaseous ions
370 aperture electrode or grid
380 receptor
385 gap or charging zone
390 grid control voltage supply While particular embodiments have been described hereinabove, alternatives, modifications, variations, improvements and substantial equivalents that are or may be presently unforeseen may arise to applicants or others skilled in the art. Accordingly, the appended claims as filed and as they may be amended are intended to embrace all such alternatives, modifications, variations, improvements and substantial equivalents.

What is claimed is:

1. A charging device, comprising:

a first electrode and a second electrode that are arranged to form a charging zone therebetween, wherein the first electrode and the second electrode each have a plate configuration and the first electrode and the second electrode are substantially parallel to each other;

a plurality of nanostructures disposed on the first and second electrodes;

a charging voltage supply operatively coupled to the first and second electrodes;

wherein the charging voltage supply is arranged to provide an alternating-current waveform comprising a square wave shape that provides a time average voltage at or near zero with a peak magnitude of from about 50 to about 750 Volts, or a peak-to-peak magnitude of from about 100 to about 1500 Volts;

a gas supply unit for storing gaseous material and being arranged to supply the gaseous material to the charging zone to produce gaseous ions; and an aperture electrode or grid downstream from and proximate to the charging zone and coupled to an included grid control voltage supply, the grid control voltage supply arranged to control a flow of the gaseous ions from the charging zone through the aperture electrode or grid to thereby charge a receptor located proximate to the aperture electrode or grid, wherein the grid control voltage supply supplies a voltage output to provide a negative DC voltage bias on the aperture electrode or grid, the negative DC bias establishes an electric field between the charging device and the receptor, and charging of the receptor with the gaseous ions ceases when a surface potential of the receptor becomes approximately equal to the voltage output of the grid control voltage supply.

2. The charging device of claim 1, where the alternating-current waveform comprises a plurality or series of successive pulses, where some of the pulses comprise a positive polarity and some of the pulses comprise a negative polarity.

3. The charging device of claim 1, where the alternating-current waveform comprises a plurality or series of successive pulses, where the pulses comprise a polarity that alternates between positive and negative so that each pulse comprises a polarity that is opposite to the polarity of the pulse that immediately precedes the each pulse.

4. The charging device of claim 1, where the alternating-current waveform comprises a plurality or series of successive pulses, where the pulses comprise a polarity that is based on a predetermined pattern.

5. The charging device of claim 1, where the nanostructures comprise at least one of carbon, boron nitride, zinc oxide, bismuth, metal chalcogenides, metals, metal-coated glass, indium tin oxide coated glass, metal-coated plastic, doped silicon and conductive organic composite materials, and where the nanostructures further comprise at least one of single-walled nanostructures (SWNT), multi-walled nanostructures (MWNT), horns, spirals, rods, wires, and fibers.

6. The charging device of claim 1, wherein the receptor travels in a process direction relative to the charging device while being charged with the gaseous ions.

7. The charging device of claim 1, wherein the surface potential of the receptor is uniform.

8. A charging device, comprising:

a first electrode and a second electrode that are arranged to form a charging zone therebetween, wherein the first electrode and the second electrode each have a plate configuration and the first electrode and the second electrode are substantially parallel to each other;

a plurality of nanostructures disposed on the first and second electrodes;

a charging voltage supply operatively coupled to the first and second electrodes;

wherein the charging voltage supply is arranged to provide an alternating-current waveform comprising a wave shape that provides a time average voltage at or near zero and that comprises a frequency of about 50 to 500 Hz;

a gas supply unit for storing gaseous material and being arranged to supply the gaseous material to the charging zone to produce gaseous ions; and an aperture electrode or grid downstream from and proximate to the charging zone and coupled to an included grid control voltage supply, the grid control voltage supply arranged to control a flow of the gaseous ions from the charging zone through the aperture electrode or grid to thereby charge a receptor located proximate to the aperture electrode or grid, wherein the grid control voltage supply supplies a voltage output to provide a negative DC voltage bias on the aperture electrode or grid, the negative DC bias establishes an electric field between the charging device and the receptor, and charging of the receptor with the gaseous ions ceases when a surface potential of the receptor becomes approximately equal to the voltage output of the grid control voltage supply.

* * * * *